US005722950A

United States Patent [19]

Fujita et al.

[11] Patent Number: 5,722,950

[45] Date of Patent: Mar. 3, 1998

[54] METHOD FOR REMOTE DELIVERY OF AN AEROSOLIZED LIQUID

[75] Inventors: Shawn M. Fujita; Jeffrey L. Southard, both of Fort Collins, Colo.

[73] Assignee: Atrix Laboratories, Inc., Fort Collins, Colo.

[21] Appl. No.: 476,796

[22] Filed: Jun. 7, 1995

[51] Int. Cl.[6] ..... A61M 31/00

[52] U.S. Cl. ..... 604/48; 604/19; 604/73; 604/82; 239/341; 222/81

[58] Field of Search ..... 604/82, 19, 48, 604/73, 131, 140; 239/341, 346; 222/173, 137, 81

[56] References Cited

U.S. PATENT DOCUMENTS

| | | |
|---|---|---|
| 2,155,658 | 4/1939 | Herrman . |
| 3,379,554 | 4/1968 | Brindamour . |
| 3,424,154 | 1/1969 | Kinsley . |
| 3,577,516 | 5/1971 | Gould . |
| 3,695,218 | 10/1972 | Herzhoff et al. . |
| 3,755,558 | 8/1973 | Scribner . |
| 3,832,459 | 8/1974 | Berkeley . |
| 3,836,647 | 9/1974 | Lange . |
| 3,847,155 | 11/1974 | Bernaola . |
| 3,878,138 | 4/1975 | Keegan et al. . |

(List continued on next page.)

FOREIGN PATENT DOCUMENTS

| | | |
|---|---|---|
| 0159293 | 10/1985 | European Pat. Off. . |
| 0521455 A2 | 1/1993 | European Pat. Off. . |
| 0537559 A1 | 4/1993 | European Pat. Off. . |
| 0539751 A1 | 5/1993 | European Pat. Off. . |
| 0560014 A1 | 9/1993 | European Pat. Off. . |
| 0586838 A1 | 3/1994 | European Pat. Off. . |
| 0649662 A1 | 4/1995 | European Pat. Off. . |
| 2126270 | 10/1972 | France . |
| 120602 | 8/1958 | New Zealand . |
| 160347 | 6/1972 | New Zealand . |
| 2017113 | 10/1979 | United Kingdom . |
| WO 85/02092 | 5/1985 | WIPO . |
| WO 90/00066 | 1/1990 | WIPO . |

OTHER PUBLICATIONS

Badger Aribrush C. 1994.

Cuschieri, The Spectrum of Laparoscopic Surgery, World J. Surg. 16, 1089–1097, 1992.

Fujimasa, Micromachining Technology and Biomedical Engineering, Applied Biochemistry and Biotechnology, vol. 38, pp. 223–242 1993.

Ozkara et al., Laparoscopic Surgery in Urology, International Urology and Nephrology, 24 (5), pp. 461–464 (1992).

Polis, Endoscopic Procedures Past, Present and Future, Today's O.R. Nurse, May/Jun. 1993 pp. 7–14.

Stellato, History of Laparscopic Surgery, Laparscopy for the General Surgeon, vol. 72, No. 5, Oct. 1992 pp. 997–1002.

Encyclopedia of Polymer Science and Engineering, vol. 2, pp. 236–237 (Biodegradable Polymers), John Wiley & Sons, Inc. (1985).

Billmeyer, Textbook of Polymer Science (Third Edition), pp. 390–391, John Wiley & Son, New York.

Gilding, Biodegradable Polymers (Chapter 9), pp. 210–232, Biocompatibility of Clinical Implant Materials.

Hawley's Condensed Chemical Dictionary (11th Ed.) pp. 224, 555 and 567, Van Nostrand Reinhold Co., NY, NY.

Holland, Polymers for Biodegradable Medical Devices, 1. The Potential of Polyesters and Controlled Macromolecular Release Systems, J. of Controlled Release 4: 155–180 (1986).

U.S. Application S/N 528,056 (select pages) Stoy.

*Primary Examiner*—Michael Powell Buiz
*Assistant Examiner*—N. Kent Gring
*Attorney, Agent, or Firm*—Merchant, Gould, Smith, Edell, Welter & Schmidt

[57] ABSTRACT

The invention provides an apparatus for remote delivery of an aerosolized liquid by laparoscopic technique, a method of delivering an aerosolized liquid into the body of an animal by means of the apparatus, and a kit that contains components of the apparatus.

5 Claims, 10 Drawing Sheets

U.S. PATENT DOCUMENTS 3,880,158 4/1975 Gurney .
3,887,699 6/1975 Yolles .
3,912,665 10/1975 Spitzer et al. .
3,912,667 10/1975 Spitzer et al. .
3,932,602 1/1976 Sweger .
3,935,308 1/1976 Wise .
3,936,402 2/1976 Keegan et al. .
4,001,151 1/1977 Keegan et al. .
4,079,893 3/1978 Bass .
4,122,158 10/1978 Schmitt .
4,161,289 7/1979 Rebold .
4,171,097 10/1979 Rebold .
4,186,190 1/1980 Gregory .
4,382,919 5/1983 Alonso et al. .
4,426,024 1/1984 Hogan .
4,495,169 1/1985 Schmolka .
4,508,705 4/1985 Chaudhuri et al. .
4,534,958 8/1985 Adams et al. .
4,534,959 8/1985 Schmolka .
4,542,012 9/1985 Dell .
4,579,731 4/1986 Fox, Jr. et al. .
4,585,647 4/1986 Schmolka .
4,588,581 5/1986 Schmolka .
4,592,728 6/1986 Davis .
4,614,787 9/1986 Szycher et al. .
4,634,027 1/1987 Kanarvogel .
4,674,658 6/1987 VanBrocklin .
4,685,596 8/1987 Mattheis .
4,721,613 1/1988 Urquhart .
4,743,440 5/1988 Callingham et al. .
4,783,340 11/1988 McDonell et al. .
4,791,149 12/1988 Pocknell .
4,822,596 4/1989 Callingham et al. .
4,899,762 2/1990 Muller .
4,921,691 5/1990 Stockel .
4,931,282 6/1990 Asmus et al. .
4,933,182 6/1990 Higashi et al. .
4,938,763 7/1990 Dunn et al. .
4,946,870 8/1990 Partain, III et al. .
4,978,072 12/1990 Kurowski .
4,979,642 12/1990 Thiebaut ..... 222/81
4,981,696 1/1991 Loomis .
4,997,425 3/1991 Shioya .
5,013,553 5/1991 Southard .
5,077,049 12/1991 Dunn et al. .
5,088,903 2/1992 Tomatsu .
5,176,907 1/1993 Leong .
5,190,220 3/1993 Bolton .
5,278,201 1/1994 Dunn et al. .
5,278,202 1/1994 Dunn et al. .
5,324,519 6/1994 Dunn et al. .
5,324,520 6/1994 Dunn et al. .
5,340,849 8/1994 Dunn et al. .
5,368,859 11/1994 Dunn et al. .
B1 4,938,763 7/1995 Dunn et al. .

METHOD FOR REMOTE DELIVERY OF AN AEROSOLIZED LIQUID

BACKGROUND OF THE INVENTION

Laparoscopic surgery has become a standard procedure over the past several years. Surgery performed by laparoscopic procedure allows for a surgery to be performed within the closed confines of the body cavity without cutting the body open. This minimally invasive surgical technique achieves results equal to or better than conventional techniques, and reduces a patient's postoperative pain, reduces exterior scars and improves cosmetic appearance. It also shortens post-operative convalescence which, in turn, can greatly reduce the cost of surgery.

Over the past several years, endoscopic surgery has become the popular alternative to conventional "open" operative procedures. Nearly every surgical discipline is affected by this technology. Fueled by patient demand, public awareness and a desire for improvement through innovation, surgeons now use endoscopic surgery to treat a variety of conditions. Gynecologists, urologists, otolaryngologists and orthopedic, thoracic and general surgeons have incorporated some type of endoscopic procedures into their practice.

Laparoscopic procedures have several drawbacks. For example, in endoscopic surgeries, like conventional open surgeries, there is a need for dressings applied to the site to inhibit bleeding or fluid flow, suturing to join or adhere adjacent tissues together, medicaments for treatment of the surgical site, among other needs. However, an endoscopic technique is not suited for applying wound dressings like surgical films, gauzes or meshes as in open surgeries in which materials can be easily manipulated to cover the intended site. In addition, the bulk and size of typical wound dressings hinders their application through a laparoscopic trocar. Also, syringes, cannulas, and conventional atomizers that may be used to apply liquids to a surgical site, do not provide for delivery of the liquid to remote sites within the body. Thus, the remoteness of the site requires the use of special techniques to achieve such applications.

Therefore, an object of the invention is to provide an aerosol delivery apparatus useful for delivering an aerosolized liquid composition to a remote site in the body of an animal by laparoscopic technique. Another object is to provide an apparatus that allows for applying a liquid composition in a desired location and as a coating having a desired thickness. Another object is to provide an apparatus for applying a wound dressing like a surgical film to cover a remote site within the body of an animal. Yet another object is to provide an apparatus for applying a biodegradable, polymeric composition to a remote area in the body. Another object is to provide a method of applying a liquid composition as an aerosol to form a coating on a tissue or surface of an organ in the body remote. A further object is to provide a kit that contains components of a apparatus for remote delivery of an aerosolized liquid.

SUMMARY OF THE INVENTION

These and other objects are achieved by the present invention that provides an apparatus for remote delivery of an aerosolized liquid by laparoscopic technique, a method of delivering an aerosolized liquid into the body of an animal by means of the apparatus, and a kit that contains the components of the apparatus.

The apparatus is sized for laparoscopic applications to deliver an aerosolized liquid to a remote location within the body of an animal. The apparatus is composed of a dispensing gun housing, tubular extension rod housing and fluid chamber tip that are interconnected by flange adaptors, and a tip portion for dispensing the aerosol from the device (i.e., aerosol dispensing tip). Each of the housings and adaptors have a central fluid channel and one or more air channels. When the apparatus is assembled, each of the air channels interconnect, and each of the fluid channels interconnect. Air and the liquid to be aerosolized are drawn up into the dispensing gun housing from external sources, and are directed into the air channels and the fluid channels, respectively.

The dispensing gun housing includes a depressible gun lever connected to an air valve. When the gun lever is depressed, air passes through the air valve into an air chamber and on into the air channel(s) to the fluid chamber tip where the air passes through apertures into a central air chamber.

The gun lever is also connected to needle or rod means that functions to dispense the air from the air chamber and the liquid from the fluid channel. The needle dispensing means is inserted through the central fluid channels and extends the length of the apparatus to the tip. The tip end of the needle dispensing means is seated in an aperture in the fluid chamber tip and in an aperture in the aerosol dispensing tip. When the gun lever is pressed downward and drawn backward, the tip of the needle is withdrawn from the apertures and air then passes from the central air chamber through the apertures. This draws liquid through the aperture of the fluid chamber tip, and the liquid/air mixture is then dispensed as an aerosol from the aerosol dispensing tip.

The apparatus also includes a mechanism for controlling the needle dispensing means in the apparatus. The needle controlling means is attached to the end of the dispensing gun housing. The needle is inserted through a channel in the needle controlling means and an attached end screw. The end screw is adjusted to apply tension on the needle so that when the gun lever is drawn forward or backward, the needle and the needle controlling means will move as a unit and the tip end of the needle will be inserted into or withdrawn from the apertures in the tip of the apparatus.

The apparatus is assembled by connecting the dispensing gun housing, extension rod housing and fluid chamber tip together via the flange adaptors, and attaching the aerosol dispensing tip and needle tension adjusting mechanism and end screw. The needle dispensing means is inserted into the channel of the end screw and needle controlling means, and then through the fluid channels into the apertures at the tip of the apparatus. The end of the needle is then secured in the needle controlling means by adjusting the end screw.

The apparatus can be used to administer a liquid composition in an aerosol form internally to a remote location in the body of an animal. In use, the extension rod housing with attached tip flange adaptor, fluid chamber tip and aerosol dispensing tip are inserted into the animal through a surgical incision using a trocar, with the dispensing gun held outside the body. The aerosol dispensing tip is positioned in the desired location adjacent the tissue or organ to be treated.

When ready to dispense the aerosol, the gun lever is depressed to introduce air through the air valve into the air channels' and the air chamber of the fluid chamber tip. The gun lever is then retracted to withdraw the end of the needle out from the apertures at the tip of the apparatus. Air is released from the central air chamber of the fluid chamber tip through the aperture of the aerosol dispensing tip which creates a vacuum in the air chamber. The vacuum operates to draw liquid from the external liquid source through the fluid channels and through the aperture of the fluid channel at the fluid chamber tip. The pressure of the air flow in the central air chamber of the fluid chamber tip causes the liquid to break into microdroplets thus forming an aerosol.

The amount of air flowing into the central air chamber of the fluid chamber tip can be increased by depressing the gun lever or adjusting an external regulator to allow more air to enter the air channels. The amount of liquid coming out of the aperture of the fluid channel of the fluid chamber tip can be increased by drawing the gun lever backward to withdraw the tip end of the needle further out of the aperture of the fluid chamber tip. This action also withdraws the tip end of the needle out of the aperture of the aerosol dispensing tip, which increases the amount of aerosol released from the apparatus.

The apparatus is useful in a laparoscopic procedure to apply a therapeutic agent, a film dressing, a film to prevent surgical adhesion formation, a polymer controlled delivery system, a hemostatic agent, and the like, to a remote area in the body. Advantageously, the apparatus may be used to apply a biodegradable, water-coagulable thermoplastic composition as an aerosol to form a coating or film over a tissue or organ of interest. The apparatus may also be used to apply a gas to dry an area of interest. Such use of the apparatus can enhance adhesion of a liquid coating onto the tissue or organ.

BRIEF DESCRIPTION OF THE DRAWINGS

Throughout the following views, reference numerals will be used in the drawings, and like reference numerals will be used throughout the several views and the description to indicate corresponding parts of the invention.

FIG. 4A is a side view of the dispensing gun housing. FIG. 4B is a cross-sectional side view of the dispensing gun housing showing the depressible air valve and air channel without the depressible gun lever. FIGS. 4C and 4D are front and rear end views, respectively, of the dispensable gun housing. FIG. 4E is a cross-sectional side view of the gun housing showing the depressible gun lever and needle dispensing means.

FIG. 5A is a side view and FIG. 5B is a cross-sectional side view of the gun flange adaptor. FIG. 5C is an end view of the gun flange adaptor along lines 5C–5C.

FIG. 6A is a side view. FIGS. 6B is a cross-sectional side view, and FIG. 6C is an end view.

FIG. 7A is a side view. FIG. 7B is a cross-sectional side view. FIG. 7C is an end view.

FIG. 8A is a side view, FIG. 8B is a cross-sectional side view. FIG. 8C is a tip end view, and FIG. 8D is a base end view.

FIG. 9A is a side view, FIG. 9B is a cross-sectional side view, FIG. 9C is a tip end view, and FIG. 9D is a base end view.

DETAILED DESCRIPTION OF THE INVENTION

The present invention provides an apparatus for delivering an aerosolized solution to a location remote from the body of the apparatus, i.e., remote delivery apparatus.

Figure 1:
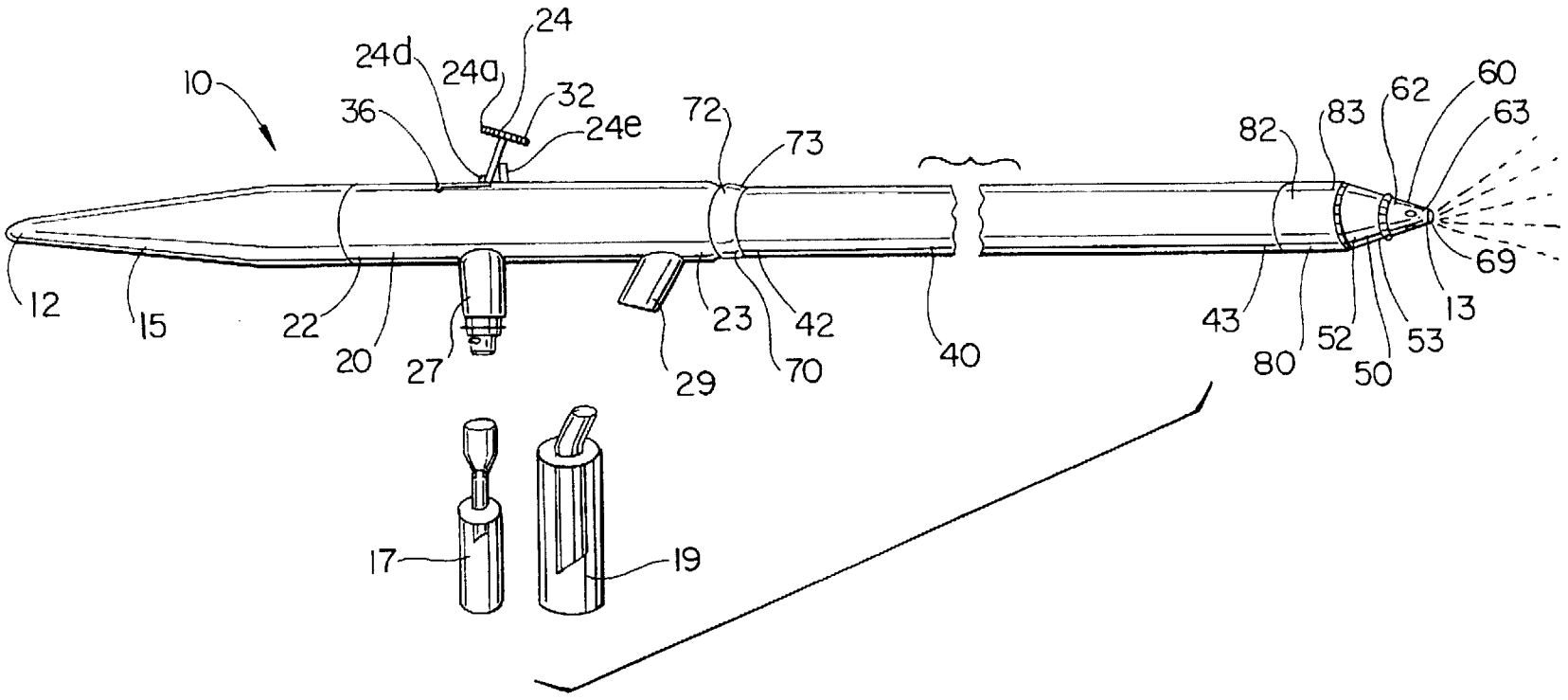
FIG. 1 is a side view of the apparatus of the invention.
Figure 2:
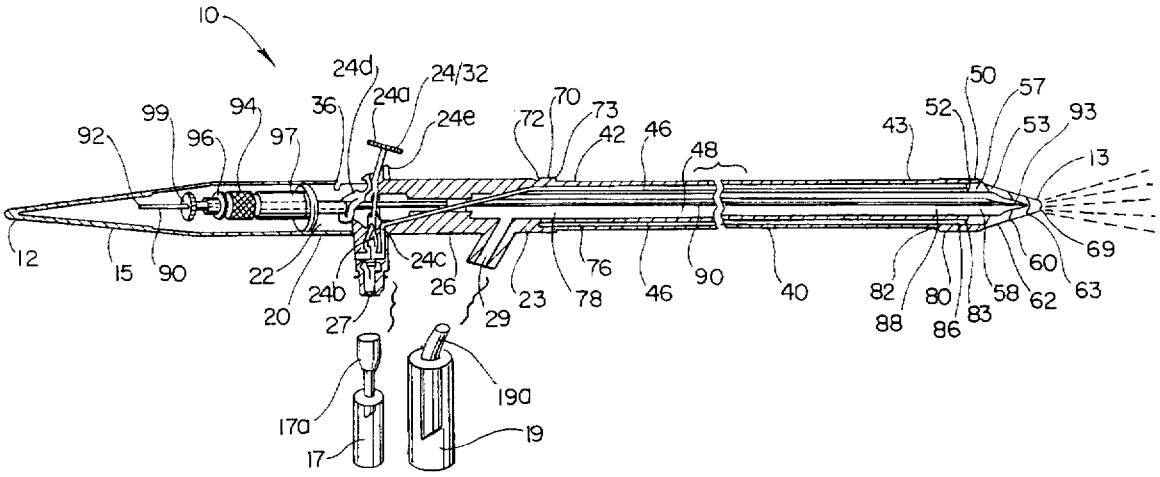
FIG. 2 is a cross-sectional view of the apparatus of FIG. 1.
Figure 3:
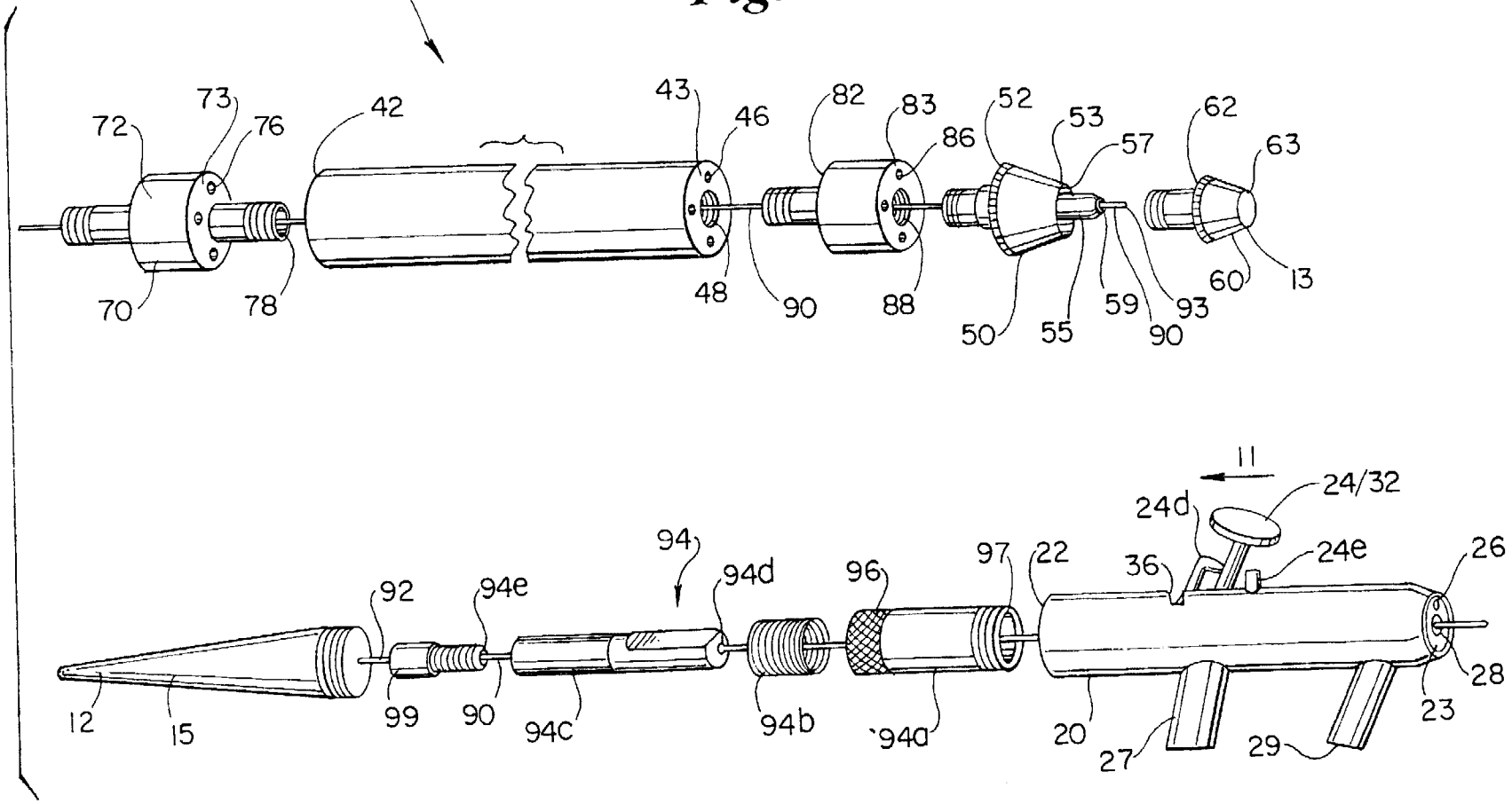
FIG. 3 is an exploded, side view of the apparatus of FIG. 1.

Referring now to the drawings, FIGS. 1–3 are illustrations of the remote delivery apparatus in accordance with the invention, designated generally by the numeral 10. As shown, apparatus 10 includes a dispensing gun housing 20 for dispensing air and fluid, tubular extension rod housing 40, fluid chamber tip 50 and aerosol dispensing tip 60, interconnected by a gun flange adaptor 70 and/or a tip flange adaptor 80, with means 90, in the form of a needle or rod for dispensing the air and liquid as an aerosol.

Dispensing gun housing

Referring to FIG. 4, dispensing gun housing 20 includes a first end 22 and a second end 23, means 24 for dispensing air into air channel 26, means 27 for conducting air from an external air source 17 into air dispensing means 24, and means 29 for conducting an external fluid source into fluid channel 28. Dispensing gun housing 20 contains at least one air channel 26. Air channel 26 extends from the air chamber **24*c* to second end 23 of dispensing gun housing 20. Fluid channel 28 extends from the fluid conducting means 29 to second end 23 of dispensing gun housing 20**.

As shown in FIG. 4, air dispensing means 24 is composed of a depressible gun lever **24*a* that is inserted into dispensing gun housing 20 through a channelled aperture 36. Gun lever 24*a* is placed in contact with a depressible air valve 24*b* connected to an external air source 17 through conducting means 27. Gun lever 24*a* is operable to depress air valve 24*b* which allows air to pass into air chamber 24*c* and then into air channel 26**.

The dispensing gun 20 is sized to be held within a person's hand. Preferably, dispensing gun housing 20 has a length 21 of about 6–10 cm, an inner diameter **34*a* of first end 22 of about 9 mm, and an inner diameter 34*b* of second end 23** of about 9 mm.

Extension rod housing

Figure 6C:
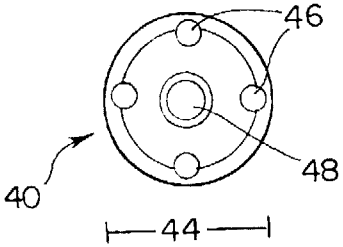
FIGS. 6A–6C is the extension rod housing of the apparatus of FIG. 1.
Figure 6A:
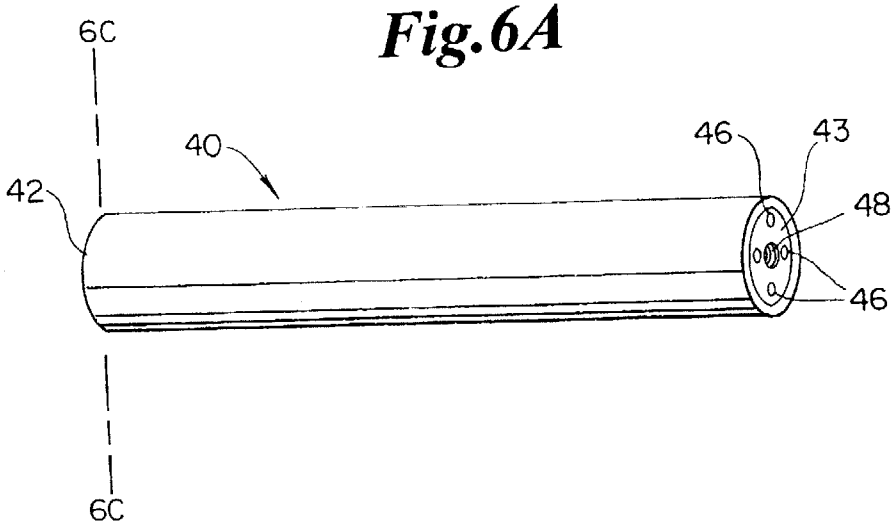
Figure 6B:
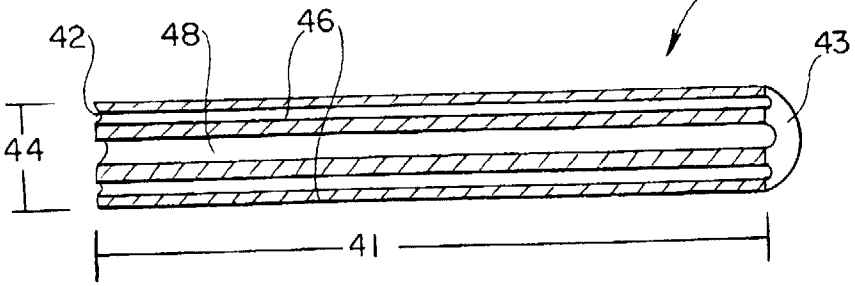

As shown in FIG. 6, extension rod housing 40 is a tubular structure adapted for laparoscopic administration into the body of an animal. Preferably, extension rod housing 40 is made of 316 surgical grade stainless steel, titanium, or plastic. Extension rod housing 40 has a first end 42 and a second end 43, an air channel(s) 46 and fluid channel 48 that extend lengthwise therethrough. First end 42 is adapted for connection to second end 23 of gun housing 20, and second end 43 is adapted for connection to first end 52 of fluid chamber tip 50. Fluid channel 48 is positioned in about the center of rod housing 40. Although in a preferred embodiment, extension rod housing 40 has four air channels as shown, it can be made with 1–3 or more than four air channels 46 as desired.

In a preferred embodiment, tubular extension rod housing 40 has a length 41 of about 30–38 cm (about 12–15 inches), and outer diameter 44 of about 5–10 mm.

Fluid chamber tip

Referring to FIG. 8, fluid chamber tip 50 is cone-shaped with a first (base) end 52 and a second (tip) end 53. Fluid channel 58 extends lengthwise through fluid chamber tip 50 ending in a projection 55 that extends beyond tip end 53. First (base) end 52 is adapted for connection to second end 73 of gun flange adaptor 70. Second (tip) end 53 is adapted for connection to first end 62 of aerosol dispensing tip 60.

Liquid passing through the fluid channels is dispensed from fluid channel 58 through aperture 59 at the end of projection 55. Base end 52 includes aperture(s) 56 through which air passes into a central air chamber 57. When apparatus 10 is assembled, aperture(s) 56 in base end 52 correspond to air channel(s) 86 of tip flange adaptor 80.

Fluid chamber tip 50 preferably has a length 51 of about 8 mm, an inner diameter 54*a* at base end 52 of about 9.5 mm, and an inner diameter 54*b* at tip end 53 about 6 mm.

Aerosol dispensing tip

As shown in FIG. 9, aerosol dispensing tip 60 is cone-shaped with a first (base) end 62 and a second (tip) end 63. First end 62 is adapted for connection to second end 53 of fluid chamber tip 50. As shown, first end 62 is a male thread joint sized to be received into a female thread joint at end 53 of the fluid chamber tip 50, with a channel 65 sized to receive projection 55 of fluid chamber tip 50 therein when apparatus 10 is assembled.

First end 62 functions as a cover over air chamber 57 when apparatus 10 is assembled and includes an aperture 67. Tip end 93 of needle dispensing means 90 is inserted into aperture 67 to seal the air inside air chamber 57. When tip end 93 is withdrawn from aperture 67, air passes from the central air chamber 57 through aperture 67 which draws liquid through aperture 59 of fluid chamber tip 50. The liquid and air are mixed together to form an aerosol which is dispensed through aperture 67 of the aerosol dispensing tip 60.

In a preferred embodiment, aerosol dispensing tip 60 has a length 61 of about 7 mm, an outer diameter 64*a* at base end 62 about 8 mm, an inner diameter 64*b* at tip end 63 of about 2–8 mm, and an outer diameter 64*c* of the male thread joint of about 3–4 mm.

Flange adaptors

As shown in FIG. 3, extension rod housing 40 is connected to the dispensing gun housing 20 via gun flange adaptor 70, and to fluid chamber tip 50 via tip flange adaptor 80. Each of the adaptors 70, 80, respectively, include an air channel 76, 86, and a fluid channel 78, 88 in about their center, that extend lengthwise therethrough.

Figure 5C:
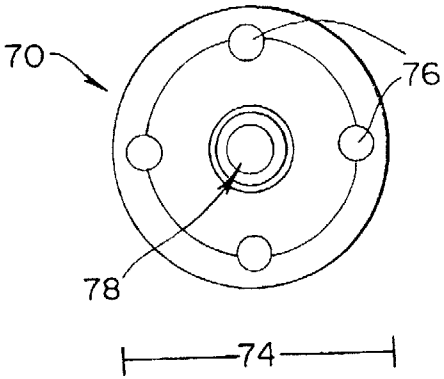
FIGS. 5A–5C is the gun flange adaptor of the apparatus of FIG. 1.
Figure 5A:
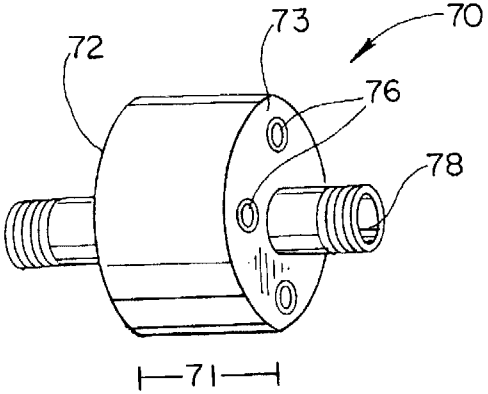
Figure 5B:
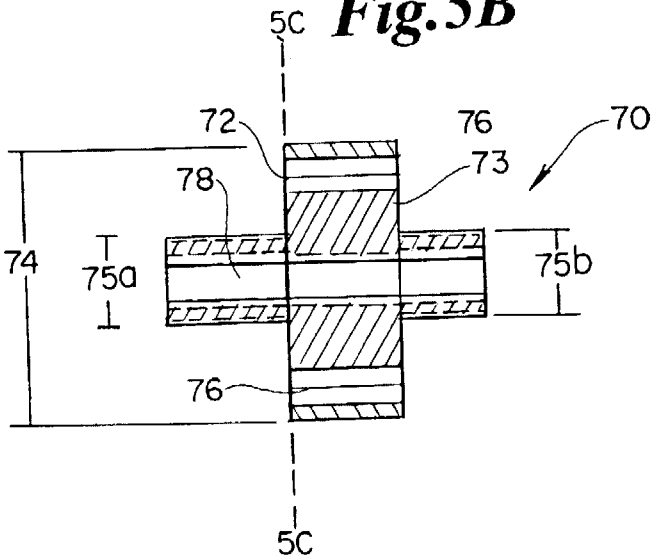

Referring to FIGS. 3 and 5, first end 72 of gun flange adaptor 70 is adapted for connection to second end 23 of the dispensing gun housing 20. Second end 73 is adapted for connection to first end 42 of extension rod housing 40. In a preferred embodiment as shown, gun flange adaptor 70 has male thread joints at both ends 72, 73, that are receivable in female thread joints at ends 23, 42 of the gun housing 20 and rod housing 40, respectively.

Figure 7C:
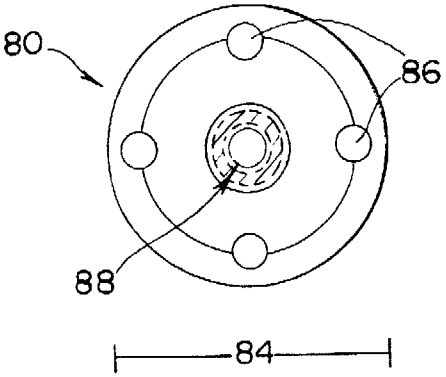
FIGS. 7A–7C is the tip flange adaptor of the apparatus of FIG. 1.
Figure 7A:
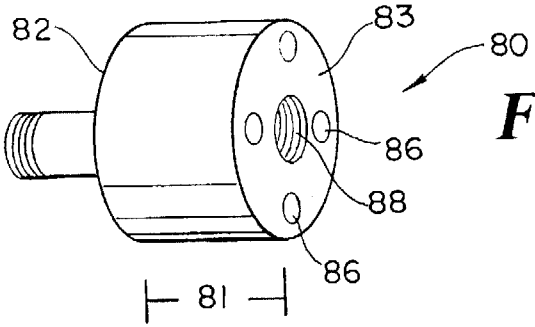
Figure 7B:
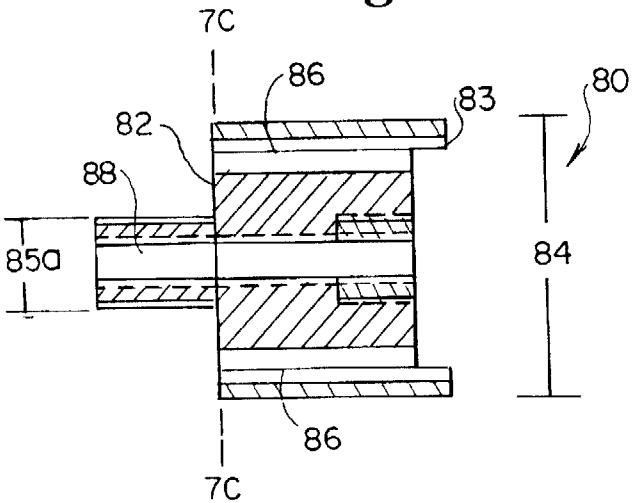
Figure 8C:
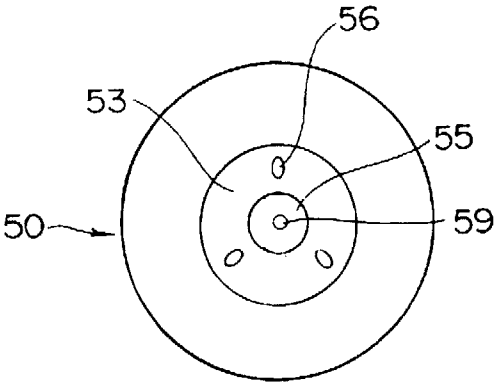
FIGS. 8A–8D are views of the fluid chamber tip of the apparatus of FIG. 1.
Figure 8D:
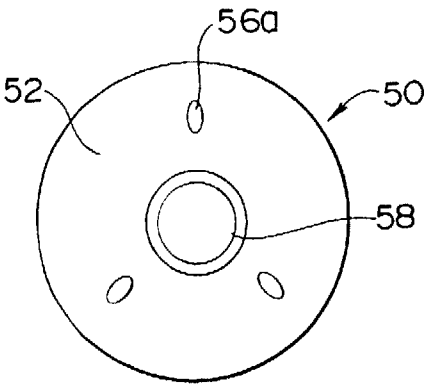
Figure 8A:
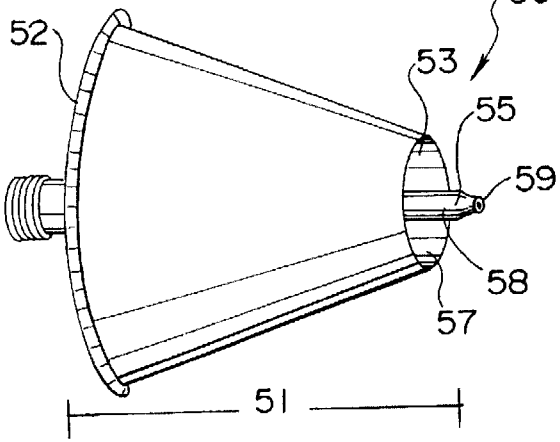
Figure 8B:
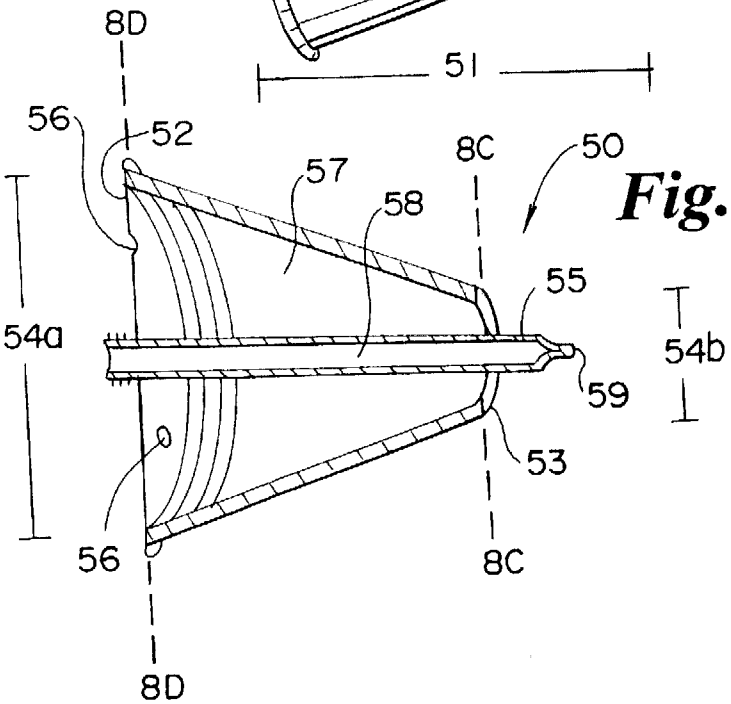
Figure 9C:
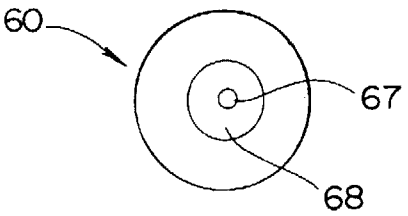
FIGS. 9A–9D are views of the aerosol dispensing tip of the apparatus of FIG. 1.
Figure 9D:
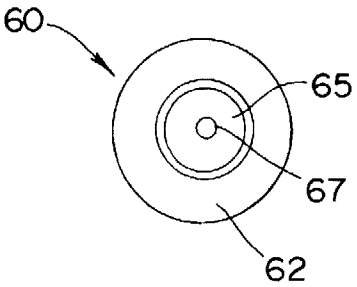
Figure 9A:
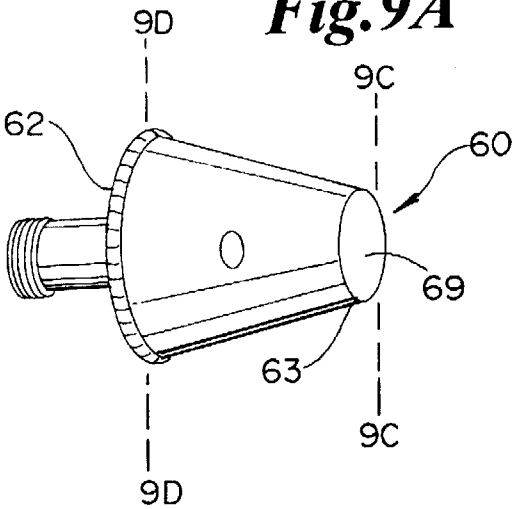
Figure 9B:
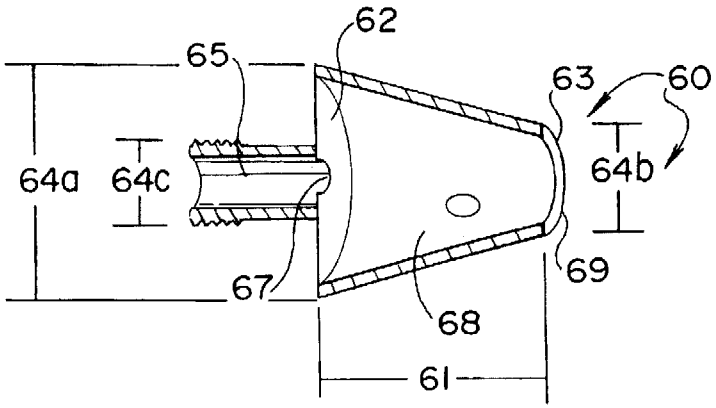

Referring to FIGS. 3 and 7, first end 82 of tip flange adaptor 80 is adapted for connection to second end 43 of the extension rod housing 40. Second end 83 is adapted for connection to first end 52 of the fluid chamber tip 50. In a preferred embodiment, tip flange adaptor 80 has a male thread joint at first end 82 that is sized to be received in a female thread joint at end 43 of the rod housing 40, and a female thread joint at second end 83 sized for receiving a male thread joint at end 52 of fluid chamber tip 50.

In a preferred embodiment, adaptors 70, 80 have four air channels 76, 86, respectively, as shown. It is understood that adaptors 70, 80 are made with a similar number of air channels as the extension rod housing 40.

When the apparatus 10 is assembled, there is a space between second end 23 of dispensing gun housing 20 and first end 72 of gun flange adaptor 70 such that air from air channel 26 passes into the space and into each of the air channels 76. When the dispensing gun housing 20, gun flange adaptor 70, extension rod housing 40, tip flange adaptor 80, and fluid chamber tip 50 are connected together, each of the air channels 76, 46 and 86 interconnect, and each of the fluid channels 28, 78, 48, 88 and 58 interconnect. In addition, air channel(s) 86 of tip flange adaptor 80 interconnect to air apertures 56 in base end 52 of fluid chamber tip 50.

Preferably, gun flange adaptor 70 has a length 71 of about 1–1.5 cm (not including the male thread joints), an outer diameter 74 of about 5–10 mm, with outer diameters 75*a*, 75*b* of the male thread joints each about 3–4 mm. Tip flange adaptor 80 preferably has a length 81 of about 1–1.5 cm (not including the male thread joint) and an outer diameter 84 about 5–10 mm, with outer diameter 85*a* of the male thread joint about 3–4 mm, and inner diameter 85*b* of the female thread joint about 3–4 mm.

Needle dispensing means

Apparatus 10 further includes means 90 for dispensing the aerosolized liquid from apparatus 10 which is in the form of a needle or rod, as shown in FIG. 3. Needle dispensing means 90 has a first end 92 and a second (tip) end 93, and is sized to be inserted into and slidably received within each of the fluid channels 28, 48, 58, 78 and 88.

Second (tip) end 93 is sized for insertion into aperture 59 at fluid channel 58 of fluid chamber tip 50 and to seal aperture 59 so that fluid cannot pass through. Second (tip) end 93 is also sized to be inserted into aperture 67 of aerosol dispensing tip 60, and to seal aperture 67 so that air does not pass out of central air chamber 57 of fluid chamber tip 50. In use, when second (tip) end 93 of needle dispensing means 90 is withdrawn from apertures 59 and 67, the aerosolized liquid is dispensed through aperture 67 as a spray.

Needle moving means

Figure 4C:
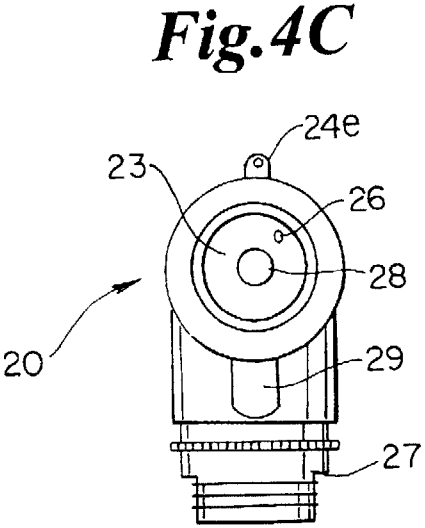
FIGS. 4A–4E are views of the dispensing gun housing of the apparatus of FIG. 1.
Figure 4D:
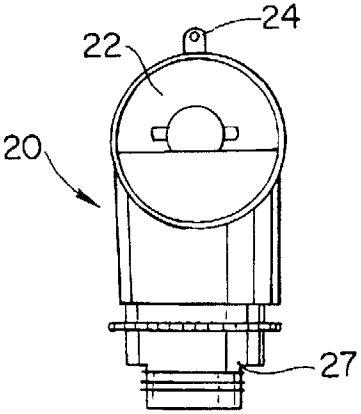
Figure 4A:
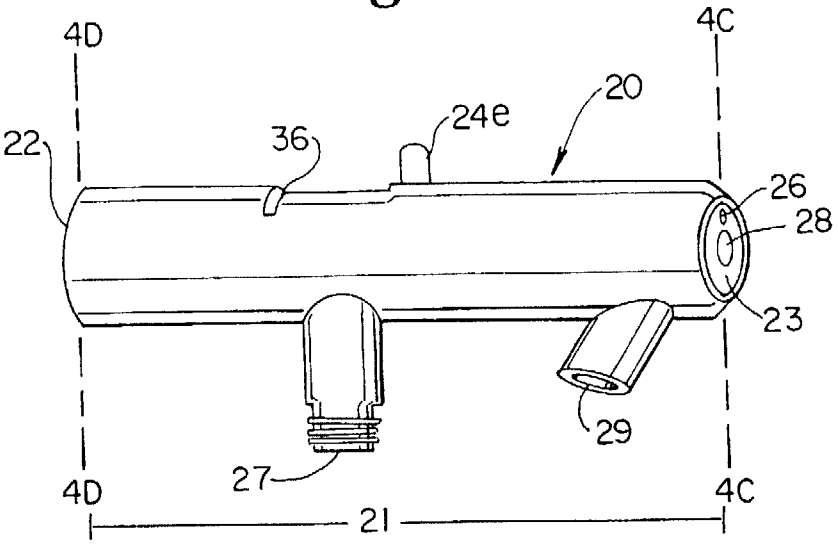
Figure 4B:
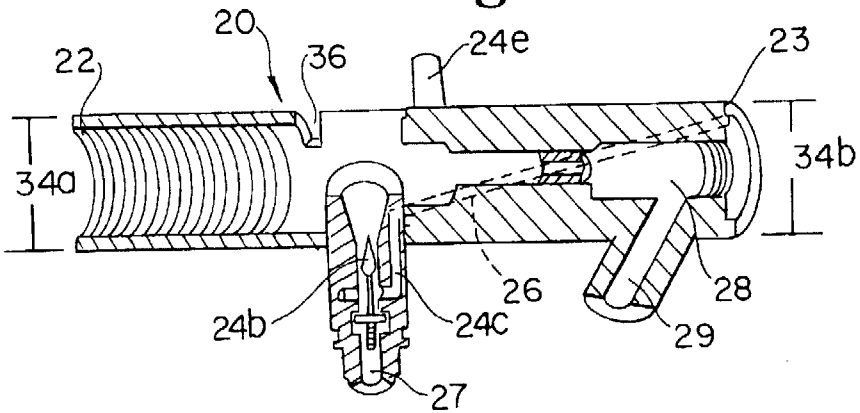
Figure 4E:
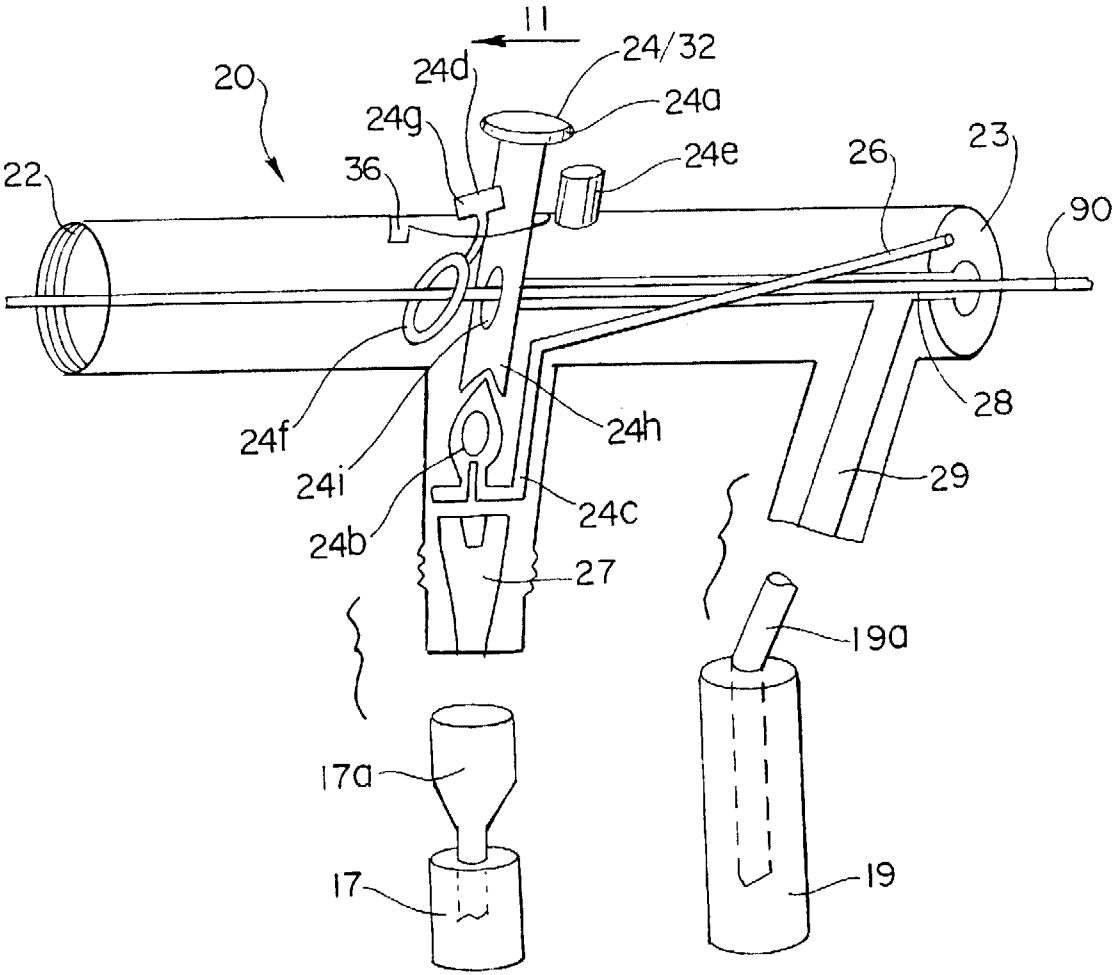

Apparatus 10 also includes means 32 for moving the needle dispensing means 90 within the fluid channels of apparatus 10. In a preferred embodiment, as shown in FIG. 4E, gun lever 24*a* is attached to needle dispensing means 90 and operates to move needle 90 within apparatus 10.

By moving the gun lever 24*a* in the direction of arrow 11, second end 93 of needle 90 is withdrawn out of apertures 59 and 67. Air flows out of central air chamber 57 of fluid chamber 50 which draws the liquid through aperture 59. The air and liquid mix together to form an aerosol which passes through aperture 67 and then through aperture 69 of aerosol dispensing tip 60 as a spray.

Associated with the depressible gun lever 24*a* is means 24*d* for adjusting tension on gun lever 24*a*. As shown in FIG. 4E, tension adjusting means 24*d* includes a loop portion 24*f* through which needle dispensing means 90 is threaded and a projection 24*g* that abuts gun lever 24*a*. When gun lever 24*a* is positioned in the forward position (opposite direction of arrow 11), it is in contact with protrusion 24*e* that functions as a stop. As gun lever 24*a* is drawn in the direction of arrow 11, projection 24*g* provides tension against gun lever 24*a* so that the amount of aerosol that is dispensed can be controlled.

Needle tension adjusting means

As shown in FIG. 3, apparatus 10 also includes a needle controlling means 94 with needle tension adjusting means 99 which is preferably a clamping end screw or bolt. In a preferred embodiment, as shown, needle controlling means 94 is a 3-part structure made of an outer tubular collar 94*a*, a spring 94b and an inner tubular structure 94c. When assembled, needle controlling means 94 has a first end 96 and a second end 97. First end 96 is adapted as a female thread joint for connection to the end screw 99. Second end 97 is adapted, preferably as a male thread joint, for connection to dispensing gun housing 20 at first end 22 which is preferably a female thread joint. When connected to dispensing gun housing 22, projection 24g abuts inner tubular structure 94c and spring 94b, and spring 94b applies pressure (tension) against projection 24g.

Needle dispensing means 90 is inserted into a channels 94d, 94e that extend lengthwise through needle controlling means 94 and needle tension adjusting means 99 (clamping end screw), respectively, and which are sized to slidably receive needle dispensing means 90 therethrough. Needle tension adjusting means 99 has a clamp/screw configuration such that as the screw is tightened, increasing more pressure is applied to needle dispensing means 90. Thus, by tightening clamping end screw 99, first end 92 of needle dispensing means 90 is secured within needle controlling means 94. When gun lever 24a is then drawn backward in the direction of arrow 11 (or forward in the opposite direction), needle controlling means 94, clamping end screw 99 and needle dispensing means 90 move together as a unit. This allows first end 93 of needle dispensing means 90 to be withdrawn from and inserted into apertures 59 and 67 at tip 13 of apparatus 10.

Assembly

To assemble apparatus 10, first end 72 (male thread joint) of gun flange adaptor 70 is connected to second end 23 (female thread joint) of dispensing gun housing 20. First end 42 (female thread joint) of extension rod housing 40 is connected to second end 73 (male thread joint) of gun flange adaptor 70. First end 82 (male thread joint) of tip flange adaptor 80 is connected to second end 43 (female thread joint) of extension rod housing 40. First end 52 (male thread joint) of fluid chamber tip 50 is connected to second end 83 (female thread joint) of tip flange adaptor 80. First end 62 (male thread joint) of aerosol dispensing tip 60 is then connected to second end 53 (female thread joint) of fluid chamber tip 50.

Gun lever 24a is then inserted into channel 36 of dispensing gun housing 20, so that its inverted point 24h is placed onto air spring valve joint 24b, as shown in FIG. 4E. Gun lever tension adjuster 24d is also inserted into channel 36 adjacent gun lever 24a. Needle controller 94a is then connected to (screwed into) first end 22 of dispensing gun housing 20 until 94c abuts gun lever 24f.

Needle dispensing means 90 is inserted into channel 94d of needle controller 94 and channel 94e of end screw 99a, threaded through loop 24f of gun lever tension adjuster 24d and through aperture 24i of gun lever 24a. Needle dispensing means 90 is then inserted through an apertured washer (not shown) into fluid channels 28, 58, 68, 78 and 88, and then needle tip end 93 is seated into aperture 59 of fluid chamber tip 50. When inserted into aperture 59, tip end 93 functions to seal fluid channel 58 of fluid chamber tip 50. Needle dispensing means 90 is then secured within needle controller 90 by adjusting end screw 99.

In a preferred embodiment, the inner diameter of each of the air channels 26, 46, 56, 76 and 86 is about 1–1.5 mm. The inner diameter of each of the fluid channels 28, 48, 58, 78 and 88 is preferably about 2–4 mm. Needle 90 is sized to be slidably received within each of the fluid channels and to extend the length of the apparatus, preferably being about 48–50 cm in length and about 1–1.25 mm in diameter.

The housings, flange adaptors and tips of apparatus 10 are preferably made of surgical grade 316 stainless steel, titanium, or plastic, or other material that is manufactured to be flexible. Needle dispensing means 90 is flexible so that the extension rod housing 40 with needle 90 inserted therein can be readily maneuvered when inserted into the body of the animal. Preferably, needle dispensing means 90 is made of surgical grade 316 stainless steel, titanium or plastic.

Operation of the apparatus

In use, apparatus 10 operates as follows. As shown in FIG. 4E, gun lever 24a rests on air spring-valve joint 24b that is directly connected to an external source of air 17 through conducting means 27. A ball seal contained within the air spring-valve joint 24b, separates and seals an air valve chamber 24c within the air valve joint 24b from external air source 17. An air channel 26 extends from air chamber 24c to second end 23 of dispensing gun housing. The air channel 26 connects to air channel(s) 76 in the gun flange adapter 70, which connects to air channel(s) 46 in rod extension housing 40, which, in turn, connects to an air channel(s) 86 in tip flange adaptor 80.

First (base) end 52 of fluid chamber tip 50 includes aperture(s) 56 that correspond to air channel(s) 86. Fluid chamber tip 50 contains a larger air chamber 57. Air is directed into air chamber 57 through aperture(s) 56. First (base) end 62 of aerosol dispensing tip 60 acts as a cover over air chamber 57. When tip end 93 of needle 90 is inserted into aperture 67 of base end 62, no air passes out of air chamber 57. When tip end 93 is withdrawn from aperture 67, air is passes into channel 68 and out aperture 69 of aerosol dispensing tip 60.

As gun lever 24a is depressed, the spring valve joint 24b is depressed allowing air to enter into the spring valve joint air chamber 24c. The air is then directed out of the spring valve joint air chamber 24c into air channels 26, 76, 46 and 86, respectively, and through aperture(s) 56 into air chamber 57 in fluid chamber tip 50.

As gun lever 24a is pulled in the direction of arrow 11, gun lever 24a pushes against gun lever tension adjuster 24d and needle controller 94. The needle controller 94 and needle 90 are moved in the direction of arrow 11 whereupon tip end 93 is withdrawn from aperture 59 at fluid chamber tip 50. At the same time, tip end 93 is withdrawn from aperture 67 of aerosol dispensing tip 60. Air flowing out through aperture 67 creates a vacuum within central air chamber 57 of fluid chamber tip 50. This vacuum draws liquid out of the external liquid source container 19, through the fluid channels and out aperture 59 of fluid chamber tip 50. The pressure of the air flow causes a breakup of the fluid into microdroplets resulting in an aerosol. The amount of air flowing out apertures 67, 69 of aerosol dispensing tip 60 can be increased by depressing gun lever 24a or adjusting a regulator to allow more air into the channels. The amount of fluid coming out of aperture 69 can be increased by pulling gun lever 24a further in the direction of arrow 11 to withdraw tip end 93 further out of aperture 59.

Thus, the amount of aerosol flowing out of aperture 59 can be controlled by the placement of tip end 93 of needle dispensing means 90 in apertures 59 and 67. As tip end 93 is withdrawn from aperture 59, a larger amount of liquid will be released with the air from air chamber 57, and more aerosol will be released from apertures 67, 69.

Use of the Apparatus

To use the apparatus to administer a an aerosolized liquid composition into the body of an animal, apparatus 10 is sterilized by γ-irradiation, autoclave, dry heat, or ethylene oxide. A surgical incision is made into the body of the animal under anesthesia, and the extension rod housing 40 with attached tip flange adaptor 80, fluid chamber tip 50 and aerosol dispensing tip 40 are inserted into the body using a trocar according to proper protocol for laparoscopic surgery, and manipulated so as to position end 13 in the desired location adjacent the tissue or organ to be treated. When end 13 of apparatus 10 is in position, the apparatus is ready to dispense the aerosolized liquid to the site. To do so, the user holds the dispensing gun 40 in their hand, depresses gun lever 24*a* to draw air into the apparatus, and pulls back on lever 24*a* to dispense the aerosolized liquid onto the site. It is preferred that the apparatus is primed prior to insertion into the body.

Apparatus 10 can also be used to dry a tissue, organ or other body part prior to applying an aerosolized liquid. To do so, fluid conducting means 29 would be detached from external fluid source 19 and the end blocked. Gun lever 24*a* would then be depressed and drawn back to dispense air onto the site. Drying of the body area can enhance adhesion of the liquid composition.

Modules/Kit

Apparatus 10 can be constructed and/or packaged as separate, detachable modules that can be later interconnected together. A single module can be composed of the following components, either alone or in combination: (i) the dispensing gun housing 20; (ii) the tubular extension rod 40; (iii) the fluid chamber tip 50; (iv) the aerosol dispensing tip 60; (v) the gun flange adaptor 70; (vi) the tip flange adaptor 80; (vii) the needle dispensing means 90; (viii) the tubular needle controlling means 94 and needle tension adjusting means 99; (ix) a regulator for air; (x) an external air source 17 with means 17*a* for conducting the air to the air dispensing means 24; and/or (xi) an external fluid source 19 with means 19*a* for conducting the fluid into the external fluid source conducting means 29; either alone or in combination. Preferably, a module containing the dispensing gun housing 20 includes air dispensing means 24 with depressible gun lever 24a and depressible air valve 24*b*, and lever tension adjusting means 24*d*; and the needle controlling/securing means 94 with needle tension adjusting means 99. It is preferred that apparatus 10 and/or a module can be disassembled into individual parts to facilitate cleaning, sterilization of the apparatus, and/or replacement of parts.

The modules can be packaged together as part of an article of manufacture, or kit. The modules can be contained within or separately packaged within a packaging material, such as a box or bag. The kit may further include instructions for assembling the parts of the apparatus together, and/or use of the apparatus. Such instructions can be in the form of a package insert, a label or tag, and the like.

Air source and liquid formulations

The apparatus is useful for laparoscopically dispensing a wide range of liquids as an aerosol to a remote site in the body.

The air source can be $CO_2$, nitrogen, or other inert gas.

The liquid can be a preparation comprising a biologically-active agent such as a drug or medicament, for example, an antibacterial or antiviral agent, an anti-inflammatory agent, analgesic agent, growth factor, hormone, vaccine agent, cardiovascular agent, bronchodilator, vasodilator, and the like, as known and used in the art. The liquid preparation can be formulated with a pharmaceutically-acceptable carrier such as water, saline, Ringer's solution, dextrose solution, and the like, with optional additives such as a preservative, antioxidant, stabilizer, absorption enhancer, and the like.

In a preferred application, apparatus 10 can be advantageously used to deliver a liquid composition composed of a biodegradable or bioerodible, water-insoluble thermoplastic polymer or copolymer dissolved in an organic solvent that is nontoxic and water-miscible or water-dispersible. When the liquid polymer solution is placed into the body and contacted by an aqueous medium such blood, lymph or other body fluid, the organic solvent will diffuse away from the polymer into surrounding aqueous tissue fluids to leave the water-insoluble polymer to coagulate or solidify into a solid structure.

Useful thermoplastic polymers are solids that have solubility parameters that allow the polymer to dissolve in an organic solvent, and coagulate or solidify when the organic solvent dissipates from the polymer solution and the polymer is contacted with an aqueous medium. Preferred thermoplastic polymers include polylactide, polycaprolactone, polyglycolide, and copolymers thereof with each other and glycolide. Suitable organic solvents are those that are biocompatible and miscible or dispersible in an aqueous medium so that the organic solvent will diffuse quickly into body fluids and allow water to permeate into the polymer solution to allow the thermoplastic polymer to coagulate to form a solid structure such as a film or implant. Preferred organic solvents are N-methylpyrrolidone, dimethyl sulfoxide (DMSO), and ethyl lactate. Examples of suitable polymer compositions are described, for example, in U.S. Pat. Nos. 4,938,763, 5,077,049 and 5,278,201.

The liquid polymer composition can be applied as an aerosol to coat a tissue or organ whereupon it will form a film or dressing. The resulting film can provide mechanical protection of a wound, prevention of microbial contamination, prevention of wound dehydration, localized delivery of a therapeutic agent, among other uses. The liquid polymer composition can also be applied as an aerosol to the surfaces of adjacent tissues to adhere the tissues together. The composition can also be applied to (or with) other barriers as an adhesive or protective coating. The polymer coating will be gradually absorbed into surrounding tissue fluids and broken down by enzymatic, chemical and/or cellular hydrolytic action. The polymer composition can further include a biologically-active agent wherein the coating can function as a sustained or time-release matrix for the agent.

The liquid can also be a liquid thermoplastic polymer without organic solvent, combined with a bioactive agent to form a liquid drug delivery system for controlled release of the active agent. The polymer is a low molecular weight, biodegradable, water-insoluble polymer or copolymer that is maintained as a liquid before and after introduction into the body of an animal. The polymer composition in an aqueous environment will remain in liquid form and not precipitate to form a dense, solid mass. The liquid polymer implant provides for faster delivery of an active agent such as a high molecular weight protein, that is slow to release from a solid implant. Preferred polymers include low molecular weight polycaprolactones, polylactides and polyglycolides, and copolymers thereof, as well as copolymers of such polymers with a water-soluble polymer such as poly(ethylene glycol), an ethylene oxide-propylene oxide block copolymer, a poly (amino acid), and the like.

The invention has been described by reference to the above-described examples and methodologies. These examples are not meant to limit the scope of the invention that has been set forth in the foregoing description. Variation within the concepts of the invention are apparent to those skilled in the art. The disclosures of the cited patents and other references are incorporated by reference herein.

What is claimed is:

1. A method of applying an aerosol into the body of an animal, comprising:

(a) providing an apparatus having an air and fluid dispensing gun housing, a tubular extension rod housing adapted for laparoscopic administration, the tubular extension rod housing having a first end, a second end, an air channel and a fluid channel, each of said channels extending the length through the extension rod housing; said apparatus being connected to an external source of air and an external source of liquid; and (b) inserting the extension rod housing of said apparatus into the animal;

wherein the liquid is drawn into the fluid channels and dispensed from the second end of the extension rod to form an aerosol that is dispensed into the body of the animal.

2. The method of claim 1, wherein the liquid comprises a biologically-active agent in combination with a pharmaceutically-acceptable carrier.

3. The method of claim 1, wherein the liquid comprises a biodegradable, water-insoluble thermoplastic polymer or copolymer and a water-miscible or water-dispersible organic solvent.

4. The method of claim 3, wherein the aerosol coats a tissue or organ and forms a film thereon.

5. The method of claim 3, wherein the liquid further comprises a biologically-active agent.

* * * * *

UNITED STATES PATENT AND TRADEMARK OFFICE

CERTIFICATE OF CORRECTION

PATENT NO. : 5,722,950

DATED : MARCH 3, 1998

INVENTOR(S) : FUJITA ET AL.

It is certified that error appears in the above-identified patent and that said Letters Patent is hereby corrected as shown below:

Front page, [54] Title: insert —APPARATUS AND— before "METHOD"

Front page, [56] References, U.S. Patent Documents: "3,695,218 10/1972" should read —3,695,218 10/1989—

Front page, [56] References, U.S. Patent Documents: "5,190,220 3/1993" should read —5,190,220 5/1993—

Col. 7, line 55: insert —48,— after "28,"

Col. 8, line 66: delete the word "a" before the word "an"

Signed and Sealed this

Thirty-first Day of August, 1999

*Attest:*

Q. TODD DICKINSON

*Attesting Officer*

*Acting Commissioner of Patents and Trademarks*